US008406675B2

(12) United States Patent
Thayer et al.

(10) Patent No.: US 8,406,675 B2
(45) Date of Patent: Mar. 26, 2013

(54) APPARATUS AND METHOD FOR XEROGRAPHIC PRINTER CLEANING BLADE LUBRICATION

(75) Inventors: Bruce Earl Thayer, Spencerport, NY (US); Aaron Michael Burry, Ontario, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 508 days.

(21) Appl. No.: 12/543,846

(22) Filed: Aug. 19, 2009

(65) Prior Publication Data

US 2011/0044742 A1 Feb. 24, 2011

(51) Int. Cl.
*G03G 21/00* (2006.01)

(52) U.S. Cl. ..... 399/346

(58) Field of Classification Search ..... 399/346, 399/343, 350

See application file for complete search history.

(56) References Cited

U.S. PATENT DOCUMENTS 4,519,698 A * 5/1985 Kohyama et al. ..... 399/346
5,463,455 A 10/1995 Pozniakas et al.
7,277,653 B2 * 10/2007 Kinokuni ..... 399/71
7,362,996 B2 4/2008 Facci et al.
7,505,704 B2 3/2009 Facci et al.
2005/0008415 A1 * 1/2005 Tanaka et al. ..... 399/358
2005/0089342 A1 * 4/2005 Takura et al. ..... 399/66
2006/0133837 A1 * 6/2006 Shimojo et al. ..... 399/71
2008/0013978 A1 * 1/2008 Facci et al. ..... 399/71
2009/0214263 A1 * 8/2009 Kim et al. ..... 399/223
2010/0081077 A1 * 4/2010 Testardi et al. ..... 430/124.11

* cited by examiner

*Primary Examiner* — Walter L Lindsay, Jr.
*Assistant Examiner* — Rodney Bonnette
(74) *Attorney, Agent, or Firm* — Ronald E. Prass, Jr.; Prass LLP

(57) ABSTRACT

An apparatus (100) and method (200) that lubricates a cleaning blade in a xerographic printer is disclosed. The apparatus can include a charge receptor (110), movable in a process direction P, where the charge receptor can have a main surface (111). The apparatus can include a cleaning station (123) configured to clean the main surface of the charge receptor, where the cleaning station can include a cleaning blade (124) coupled to the main surface of the charge receptor. The apparatus can include a cleaning blade lubrication module (118) configured to place a lubrication stripe (160) on a portion of the main surface of the charge receptor at a selected time. The apparatus can include a controller (150) coupled to the cleaning blade lubrication module and coupled to the charge receptor. The controller can be configured to substantially park the cleaning blade in the lubrication stripe when the charge receptor is stopped.

11 Claims, 3 Drawing Sheets

APPARATUS AND METHOD FOR XEROGRAPHIC PRINTER CLEANING BLADE LUBRICATION

BACKGROUND

Disclosed herein is an apparatus and method that lubricates a cleaning blade in a xerographic printer.

Presently, in a typical electrostatographic printing process, a photoreceptor is charged to a substantially uniform potential so as to sensitize the surface thereof. The charged portion of the photoreceptor is exposed to a light image of an original document being reproduced. Exposure of the charged photoreceptor selectively dissipates the charges thereon in the irradiated areas. This records an electrostatic latent image on the photoreceptor corresponding to the informational areas contained within the original document. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules to the latent image, forming a toner powder image on the photoreceptor. The toner powder image is then transferred from the photoreceptor to a copy sheet. The toner particles are heated to permanently affix the powder image to the copy sheet. After each transfer process, the toner remaining on the photoconductor is cleaned by a cleaning device.

A cleaning device can use a cleaning blade to remove residual toner and other particles. Unfortunately, friction between the cleaning blade and the photoreceptor causes wear on the blade and reduced blade life. Developed toner stripes can be used to lubricate cleaning blades to increase blade life. Toner lubrication stripes are of two general types. The first type is developed when the xerographic process is cycling up or cycling out. To avoid development of carrier beads, turning on or off development bias and charging during cycle up and cycle out is sequenced to instead develop toner bands. For products dominated by short jobs followed by a cycle out, these developed toner bands can provide significant blade lubrication. The second type of toner lubrication stripe is developed at intervals that are either predetermined or determined by machine controller estimates of blade lubrication requirements based on toner usage. Blade lubrication has always been the most influential factor in increasing blade life. With the introduction of high friction photoreceptor overcoats, optimized blade lubrication is now more important not just for blade life improvement but also for maintaining acceptable blade life.

Thus, there is a need for an improved apparatus and method that lubricates a cleaning blade in a xerographic printer.

SUMMARY

An apparatus and method that lubricates a cleaning blade in a xerographic printer is disclosed. The apparatus can include a charge receptor, movable in a process direction, where the charge receptor can have a main surface. The apparatus can include a cleaning station configured to clean the main surface of the charge receptor, where the cleaning station can include a cleaning blade coupled to the main surface of the charge receptor. The apparatus can include a cleaning blade lubrication module configured to place a lubrication stripe on a portion of the main surface of the charge receptor at a selected time. The apparatus can include a controller coupled to the cleaning blade lubrication module and coupled to the charge receptor. The controller can be configured to substantially park the cleaning blade in a lubrication stripe when the charge receptor is stopped.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include an apparatus that lubricates a cleaning blade in a xerographic printer. The apparatus can include a charge receptor, movable in a process direction, where the charge receptor can have a main surface. The apparatus can include a cleaning station configured to clean the main surface of the charge receptor, where the cleaning station can include a cleaning blade coupled to the main surface of the charge receptor. The apparatus can include a cleaning blade lubrication module configured to place a lubrication stripe on a portion of the main surface of the charge receptor at a selected time. The apparatus can include a controller coupled to the cleaning blade lubrication module and coupled to the charge receptor. The controller can be configured to substantially park the cleaning blade in a lubrication stripe when the charge receptor is stopped.

The embodiments further include a method that lubricates a cleaning blade in an electrostatographic printing apparatus having a charge receptor having a main surface, having a cleaning station, the cleaning station including a cleaning blade coupled to the main surface of the charge receptor, having a cleaning blade lubrication module, and having a controller coupled to the cleaning blade lubrication module and coupled to the charge receptor. The method can include moving the charge receptor in a process direction. The method can include cleaning the main surface of the charge receptor using the cleaning station. The method can include placing, using the cleaning blade lubrication module, a lubrication stripe on a portion of the main surface of the charge receptor at a selected time. The method can include controlling the electrostatographic printing apparatus to substantially park the cleaning blade in the lubrication stripe when the charge receptor is stopped.

The embodiments further include an apparatus that lubricates a cleaning blade in a xerographic printer. The apparatus can include a media transport configured to transport media. The apparatus can include a photoreceptor movable in a process direction. The photoreceptor can have a main surface and can be configured to generate an image on the media. The apparatus can include a cleaning station configured to clean the main surface of the photoreceptor. The cleaning station can include a cleaning blade coupled to the main surface of the photoreceptor. The apparatus can include a cleaning blade lubrication module configured to place a lubrication stripe on a portion of the main surface of the photoreceptor at a selected time. The apparatus can include a controller coupled to the cleaning blade lubrication module and coupled to the photoreceptor. The controller can be configured to control the xerographic printing apparatus to substantially park the cleaning blade in the lubrication stripe when the photoreceptor is stopped.

Figure 1:
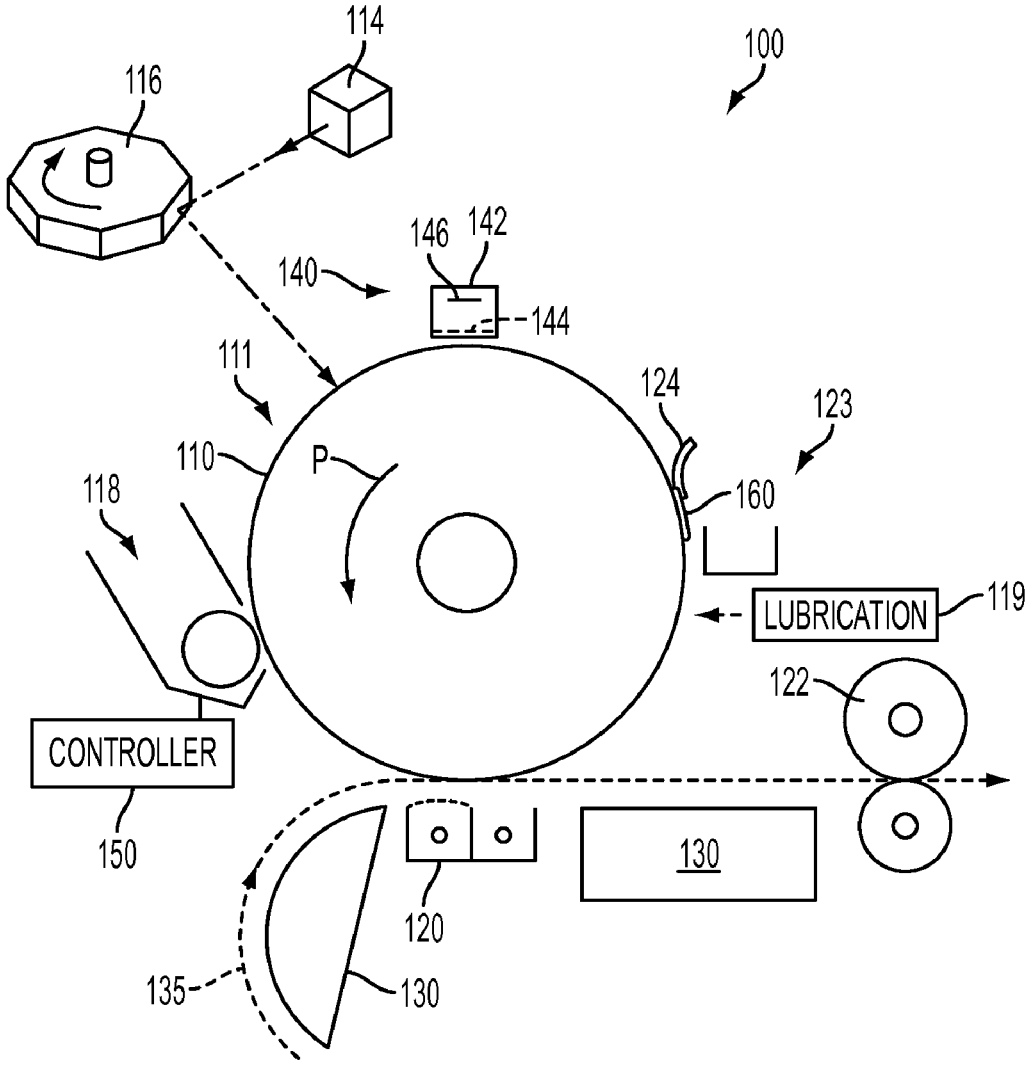
FIG. 1 is an exemplary illustration of an apparatus.

FIG. 1 is an exemplary illustration of an apparatus 100. The apparatus 100 may be a printing apparatus, a printer, a multifunction media device, a xerographic printing apparatus, an electrostatic printing apparatus, a laser printer, or any other device that generates an image on media. The apparatus 100 can include a media transport 130 that can transport media 135. The apparatus 100 can also include a charge receptor 110, such as a photoreceptor that can be configured to generate an image on the media 135. The charge receptor 110 can have a main surface 111. For example, the charge receptor 110 can be a belt or drum and can include a photoreceptor charge transport surface for forming electrostatic images thereon. The charge receptor 110 can also be a roll, an intermediate belt, an imaging drum, a transfer belt, or any other rotational assembly that can transport an image, a fluid, particles, or any other substance in a printer. The charge receptor 110 can move, operate, or rotate in a process direction P and can generate an image on the media 135.

The apparatus 100 can include a charge device 140, such as a scorotron, a charge roll, or any other electric field generation device, that can apply a voltage to the charge receptor 110. For example, a scorotron 140 can include a scorotron shield 142, a scorotron charging grid 144, and a scorotron wire or pin array 146 located on an opposite side of the scorotron charging grid 144 from the charge receptor 110. The scorotron pin array 146 can be configured to generate an electric field. The scorotron charging grid 144 and the scorotron pin array 146 can be configured to generate a surface potential on the charge receptor 110.

The charge device 140 can charge the charge receptor 110 surface by imparting an electrostatic charge on the surface of the charge receptor 110 as the charge receptor 110 rotates in the process direction P. A raster output scanner, such as a laser source, a Light Emitting Diode (LED) bar, or other relevant device, can discharge selected portions of the charge receptor 110 in a configuration corresponding to the desired image to be printed. For example, a raster output scanner can discharge a latent image to a more positive voltage. As a further example, a raster output scanner can include a laser source 114 and a rotatable mirror 116, which can act together to discharge certain areas of the main surface 111 of the charge receptor 110 according to a desired image to be printed. Other elements can be used instead of a laser source 114 to selectively discharge the charge-retentive surface, such as an LED bar, a light-lens system, or other elements that can discharge a charge-retentive surface. The laser source 114 can be modulated in accordance with digital image data fed into it, and the rotatable mirror 116 can cause the modulated beam from the laser source 114 to move in a fast-scan direction perpendicular to the process direction P of the charge receptor 110.

The apparatus 100 can include a cleaning station 123 configured to clean the main surface 111 of the charge receptor 110. The cleaning station 123 can include a cleaning blade 124 coupled to the main surface 111 of the charge receptor 110. The cleaning blade 124 can be a metering blade, a cleaning blade, or any other blade that can meter or remove a substance or material from a charge receptor. For example, the cleaning blade 124 can remove toner or other debris from the charge receptor 110 and/or can meter a lubrication fluid on the charge receptor 110.

The apparatus 100 can include a cleaning blade lubrication module 118 configured to place a lubrication stripe 160 on a portion of the main surface 111 of the charge receptor 110 at a selected time. The cleaning blade lubrication module 118 can be configured to place a lubrication stripe 160 of marking material on a portion of the main surface 111 of the charge receptor 110 at a selected time. The lubrication stripe 160 can be an imaged patch, a dedicated lubrication stripe placed in an interdocument zone on the main surface 111, a cycle out band, or any other lubrication stripe. For example, the cleaning blade lubrication module 118 can be part of a development unit that can cause a supply of marking material, such as dry toner, to contact or otherwise approach the exposed latent image on the surface of the charge receptor 110. A transfer station 120 can then cause the toner adhering to the charge receptor 110 to be electrically transferred to the media 135, such as paper, plastic, or other media, or to an intermediate transfer belt or drum to form the image thereon. The media 135 with the toner image thereon can then be passed through a fuser 122, which can cause the toner to melt, or fuse, into the media 135 to create the permanent image. When operating as the cleaning blade lubrication module 118, a development unit can place a stripe of toner as if it were an image to be printed and the toner itself can act as a lubricant.

The cleaning blade lubrication module 118 can include a development unit, can be an independent lubrication module, can be part of a development or marking system, or can be any other lubrication module located right in front of the cleaning station 123, behind the cleaning station 123, or elsewhere along the circumference of the charge receptor 110. For example, a cleaning blade lubrication module can be a separate dedicated lubrication module 119 that can place a lubrication stripe 160 on a portion of the main surface 111 of the charge receptor 110. The cleaning blade lubrication module 119 can place a lubrication stripe 160 of a material such as zinc stearate, toner, metering fluid, and other lubrication materials, on a portion of the main surface 111 of the charge receptor 110.

The apparatus 100 can include a controller 150 coupled to the cleaning blade lubrication module 118 and coupled to the charge receptor 110. The controller 150 can be configured to control operations of the apparatus 100. The controller 150 can also be configured to substantially park the cleaning blade 124 in the lubrication stripe 160 when the charge receptor 110 is stopped. The cleaning blade 124 can be substantially parked in the lubrication stripe 160 either by placing the lubrication stripe 160 directly under the cleaning blade 124 or by placing the lubrication stripe 160 right in front of the cleaning blade 124 relative to the charge receptor process direction P. The lubrication stripe 160 can be placed in an interdocument zone and can be minimized.

The controller 150 can be configured to place the lubrication stripe 160 on the portion of the main surface 111 when the charge receptor 110 is cycling out to substantially park the cleaning blade 124 in the lubrication stripe 160 when the charge receptor 110 is stopped. The charge receptor 110 can cycle out when finishing printing, when stopping the apparatus 100, and/or when shutting printing elements down until a next print job. The controller 150 can also be configured to place the lubrication stripe 160 on the portion of the main surface 111 and can be configured to control stopping of charge receptor 110 motion so that the lubrication stripe 160 has substantially just begun to go under the cleaning blade 124 when the charge receptor 110 stops. The controller 150 can be configured to substantially park the cleaning blade 124 in the lubrication stripe 160 when the charge receptor 110 is stopped so as to substantially place the lubrication stripe 160 under the cleaning blade 124 when the charge receptor 110 begins moving. The controller 150 can be configured to substantially park the cleaning blade 124 in the lubrication stripe 160 when the charge receptor 110 is stopped so as to substantially place the lubrication stripe 160 under the cleaning blade 124 when the charge receptor 110 begins moving to reduce stress on the cleaning blade 124 and increase cleaning blade life.

According to a related embodiment, the apparatus 100 can be a xerographic printing apparatus. The apparatus 100 can include a media transport 130 configured to transport media 135. The apparatus 100 can include a photoreceptor 110 operable in a process direction P. The photoreceptor 110 can have a main surface 111 and can be configured to generate an image on the media 135. The apparatus 100 can include a cleaning station 123 configured to clean the main surface 111 of the photoreceptor 110. The cleaning station 123 can include a cleaning blade 124 coupled to the main surface 111 of the photoreceptor 110. The apparatus 100 can include a cleaning blade lubrication module 118 configured to place a lubrication stripe 160 on a portion of the main surface 111 of the photoreceptor 110 at a selected time. The apparatus 100 can include a controller 150 coupled to the cleaning blade lubrication module 118 and coupled to the photoreceptor 110. The controller 150 can be configured to control the apparatus 100 to substantially park the cleaning blade 124 in the lubrication stripe 160 when the photoreceptor 110 is stopped. The controller 150 can be configured to substantially park the cleaning blade 124 in the lubrication stripe 160 when the photoreceptor 110 is stopped so as to substantially place the lubrication stripe 160 under the cleaning blade 124 when the photoreceptor 110 begins operating from a stopped position to reduce stress on the cleaning blade 124.

Typically, for a charge receptor, such as a photoreceptor, toner lubrication remains localized to the position on the photoreceptor where the toner was applied. The lubrication effect only very slowly spreads in the process direction as the cleaning blade passes over the site of the toner stripe development. Also, a cleaning blade can experience a very high strain spike when the photoreceptor starts operating in a process direction. The total wear on the cleaning blade can be expressed as a sum of the wear due to the start-up stresses and the wear due to sliding at the process speed over the cleaning surface. The wear due to start-up can be greater than the wear due to sliding for jobs of less than 6 prints. The toner, blade, and photoreceptor materials can influence how large the start-up wear is relative to the sliding wear.

To reduce the start-up stress and increase blade life, the blade tip can be lubricated during the critical start-up time. This can be accomplished by developing a toner lubrication stripe as a printer is cycling out and then timing development and stopping of photoreceptor motion so that the lubrication stripe has just begun to go under the cleaning blade when the photoreceptor stops. The toner lubrication stripe can be an imaged patch or more conveniently a cycle out band. The cycle out band can be of a minimum size, and the photoreceptor can continue to rotate until the band is just under the cleaner blade. At start-up, the cleaning blade can be in a toner lubrication stripe and as well lubricated as possible with toner. If other lubrication methods are being used, such as application of lubricants directly to the photoreceptor, these can also be timed in a similar manner to park the lubricant under the cleaning blade at cycle out.

Several experiments were performed to demonstrate the reduction in blade stress when starting the blade in a toner lubrication stripe. A cleaning blade was instrumented with strain gages and positioned against a sliding glass surface. Strain gage data was collected. Toner lubrication stripes were applied underneath the blade. This was done for a very clean, alcohol washed glass surface and for a used glass surface after it had been used for a number of passes of the blade. The used surface had been scraped clean of toner by the blade, but toner residue, primarily toner additives, remained on the surface and provided a level of lubrication.

Strain gage results for the used glass surface showed lower peak strains than when no toner lubrication stripe is used, however. When run on a higher friction surface, peak blade strain was reduced when the lubricant was positioned under the cleaning blade at start-up. An alcohol wash result demonstrated the improvement in lubrication by starting the blade in a lubrication stripe. Minimizing the number of high stress occurrences that the blade experiences can maximize blade life. Starting the blade in a lubrication stripe can provide an additional advantage when the blade is used against inherently higher friction surfaces such as overcoated photoreceptors.

The decrease in the peak strain when the lubrication stripe is positioned under the blade is dramatic when running multiple starts against the alcohol cleaned glass surface. The strain gage output for the lubrication stripe in front of the blade also shows a decrease in the peak strain and a more rapid return to the running strain for each succeeding start. This suggests that the toner lubricant is working its way under the blade tip over time. The strain gage output for the lubrication stripe under the blade did not show a decrease in peak strain from multiple starts. This demonstrates that placing the lubrication stripe under the blade at start-up can be an efficient method of quickly achieving a well lubricated condition for the blade tip.

Placing lubrication stripes under the blade tip at start-up can provide an effective method to reduce stress on the blade and thus increase blade life and reliability. Embodiments can reduce blade stress to a smaller range, which can result in more predictable and longer blade life. This can be additionally useful for blades used on high friction surfaces, such as overcoated photoreceptors.

Figure 2:
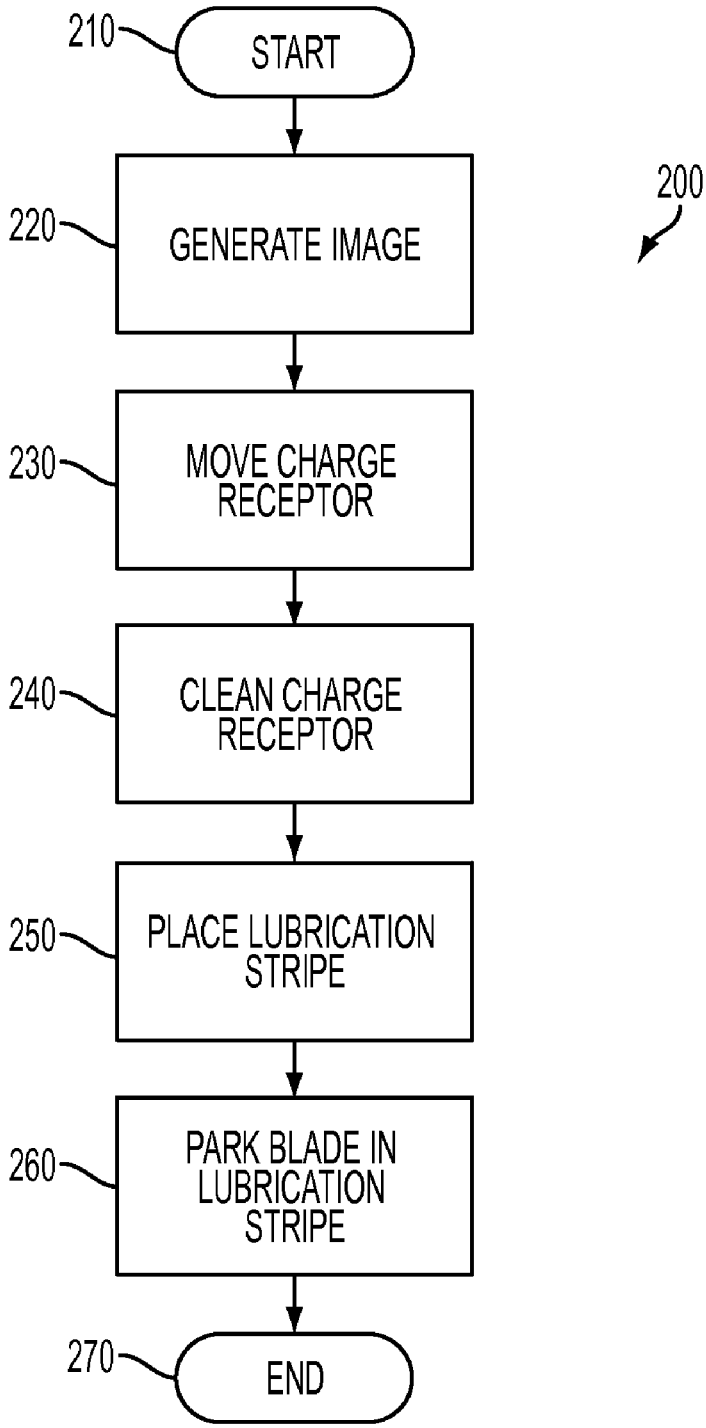
FIG. 2 is an exemplary illustration of a flowchart.

FIG. 2 illustrates an exemplary flowchart 200 of a method of lubricating a cleaning blade in a printing apparatus, such as the apparatus 100. The printing apparatus can include a charge receptor having a main surface, can include a cleaning station, the cleaning station having a cleaning blade coupled to the main surface of the charge receptor, can include a cleaning blade lubrication module, and can include a controller coupled to the cleaning blade lubrication module and coupled to the charge receptor. The method starts at 210. At 220, an image can be generated on the media using the charge receptor. At 230, the charge receptor can move in a process direction. For example, the charge receptor can rotate in the process direction. At 240, the main surface of the charge receptor can be cleaned using the cleaning station. At 250, the cleaning blade lubrication module can place a lubrication stripe on a portion of the main surface of the charge receptor at a selected time. The cleaning blade lubrication module can place a lubrication stripe by placing the lubrication stripe of marking material on a portion of the main surface of the charge receptor at a selected time.

At 260, the electrostatographic printing apparatus can be controlled to substantially park the cleaning blade in the lubrication stripe when the charge receptor is stopped. For example, the electrostatographic printing apparatus can be controlled by controlling rotation of the charge receptor in the process direction to substantially park the cleaning blade in the lubrication stripe when the charge receptor is stopped. The electrostatographic printing apparatus can be controlled by controlling placement of the lubrication stripe to substantially park the cleaning blade in the lubrication stripe when the charge receptor is stopped. The electrostatographic printing apparatus can be controlled by controlling placement of the lubrication stripe on the portion of the main surface when the charge receptor is cycling out to substantially park the cleaning blade in the lubrication stripe when the charge receptor is stopped. The electrostatographic printing apparatus can be controlled by controlling stopping of charge receptor motion so that the lubrication stripe has substantially just begun to go under the cleaning blade when the charge receptor stops. The electrostatographic printing apparatus can be controlled by controlling the electrostatographic printing apparatus to substantially park the cleaning blade in the lubrication stripe when the charge receptor is stopped so as to substantially place the lubrication stripe under the cleaning blade when the charge receptor begins moving. The electrostatographic printing apparatus can be controlled by controlling the electrostatographic printing apparatus to substantially park the cleaning blade in the lubrication stripe when the charge receptor is stopped so as to substantially place the lubrication stripe under the cleaning blade when the charge receptor begins moving to reduce stress on the cleaning blade and increase cleaning blade life. At 270, the method ends.

Figure 3:
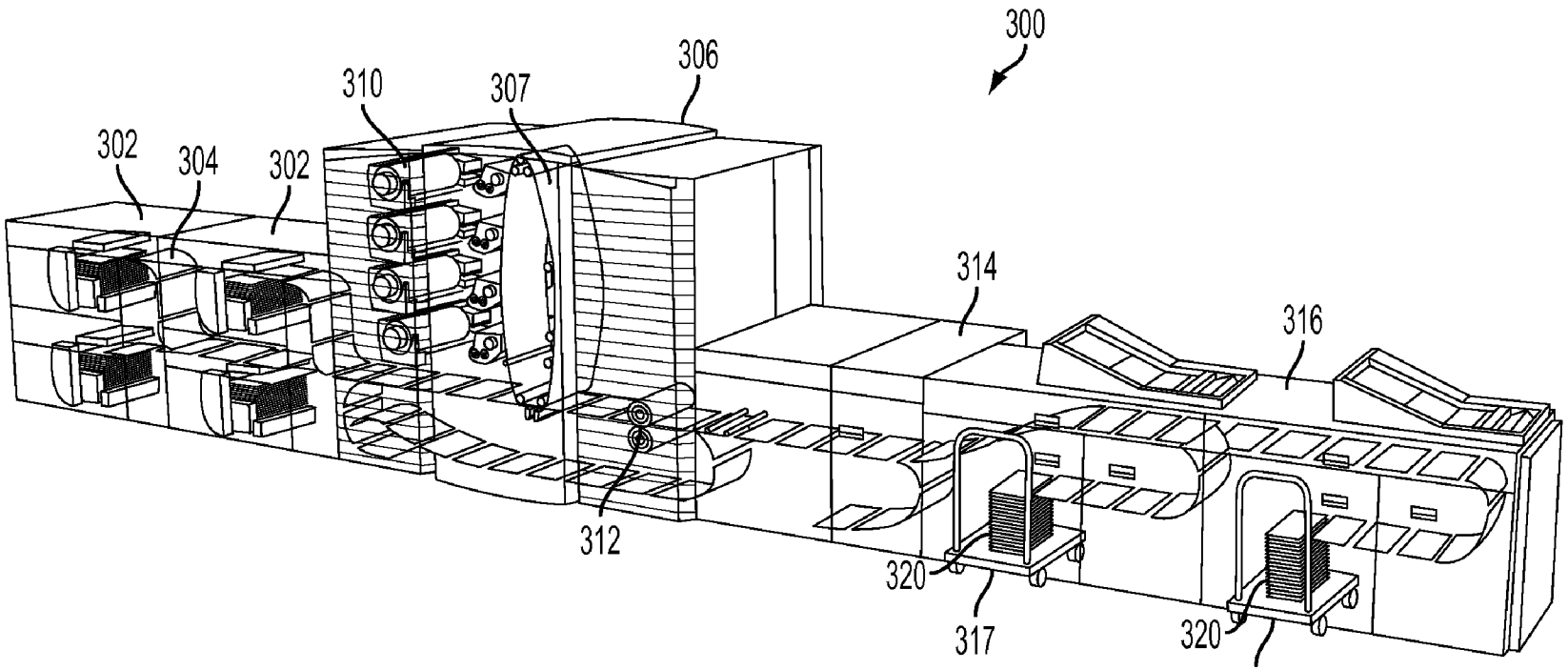
FIG. 3 is an exemplary illustration of a printing apparatus.

FIG. 3 illustrates an exemplary printing apparatus 300, such as the apparatus 100. As used herein, the term "printing apparatus" encompasses any apparatus, such as a digital copier, bookmaking machine, multifunction machine, and other printing devices that perform a print outputting function for any purpose. The printing apparatus 300 can be used to produce prints from various media, such as coated, uncoated, previously marked, or plain paper sheets. The media can have various sizes and weights. In some embodiments, the printing apparatus 300 can have a modular construction. As shown, the printing apparatus 300 can include at least one media feeder module 302, a printer module 306, which can include the apparatus 100, adjacent the media feeder module 302, an inverter module 314 adjacent the printer module 306, and at least one stacker module 316 adjacent the inverter module 314.

In the printing apparatus 300, the media feeder module 302 can be adapted to feed media 304 having various sizes, widths, lengths, and weights to the printer module 306. In the printer module 306, toner is transferred from an arrangement of developer stations 310 to a charged photoreceptor belt 307 to form toner images on the photoreceptor belt 307. The toner images are transferred to the media 304, which are fed through a paper path. The media 304 are advanced through a fuser 312, which is adapted to fuse the toner images on the media 304. The inverter module 314 manipulates the media 304, exiting the printer module 306 by either passing the media 304 through to the stacker module 316 or inverting and returning the media 304 to the printer module 306. In the stacker module 316, printed media are loaded onto stacker carts 317 to form stacks 320.

Embodiments can reduce stress on the blade tip, and thus improve blade life, by parking the blade tip in a toner lubrication stripe. High stresses experienced by the blade at process start-up can then be reduced, since the blade will be well lubricated when the cleaning surface begins to move. Cycle out toner bands or developed toner lubrication stripes can be used to lubricate the blade at process start-up. The controller can time charge receptor drive motor shutdown such that the lead edge of the toner bands or stripes is positioned under the blade. Toner transfer from the charge receptor can be disabled to provide a high density toner lubrication band or stripe.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An electrostatographic printing apparatus, comprising:

a charge receptor movable in a process direction, the charge receptor having a main surface;

a cleaning station configured to clean the main surface of the charge receptor, the cleaning station including a cleaning blade coupled to the main surface of the charge receptor;

a cleaning blade lubrication module configured to place a lubrication stripe on a portion of the main surface of the charge receptor at a selected time; and a controller coupled to the cleaning blade lubrication module and coupled to the charge receptor, the controller configured to control stopping of charge receptor motion so that the lubrication stripe has just begun to go under the cleaning blade when the charge receptor is stopped and the cleaning blade is in contact with the charge receptor.

2. The electrostatographic printing apparatus according to claim 1, wherein the controller is configured to place the lubrication stripe on the portion of the main surface when the charge receptor is cycling out.

3. The electrostatographic printing apparatus according to claim 1, wherein the cleaning blade lubrication module comprises a development unit configured to place a lubrication stripe of marking material on a portion of the main surface of the charge receptor at a selected time.

4. The electrostatographic printing apparatus according to claim 1, further comprising a media transport configured to transport media, wherein the charge receptor comprises a photoreceptor configured to generate an image on the media.

5. The electrostatographic printing apparatus according to claim 1, wherein the lubrication stripe comprises one of an imaged patch and a cycle out band.

6. The electrostatographic printing apparatus according to claim 1, wherein the cleaning blade lubrication module comprises a dedicated cleaning blade lubrication module configured to place a lubrication stripe on a portion of the main surface of the charge receptor at a selected time.

7. A method in an electrostatographic printing apparatus, the electrostatographic printing apparatus including a charge receptor having a main surface, a cleaning station, the cleaning station having a cleaning blade coupled to the main surface of the charge receptor, a cleaning blade lubrication module, and a controller coupled to the cleaning blade lubrication module and coupled to the charge receptor, the method comprising:

moving the charge receptor in a process direction;

cleaning the main surface of the charge receptor using the cleaning station;

placing, using the cleaning blade lubrication module, a lubrication stripe on a portion of the main surface of the charge receptor at a selected time; and controlling the electrostatographic printing apparatus to stop the movement of the charge receptor so that the lubrication stripe has just begun to go under the cleaning blade when the charge receptor is stopped and the cleaning blade is in contact with the charge receptor.

8. The method according to claim 7, wherein controlling comprises controlling placement of the lubrication stripe on the portion of the main surface when the charge receptor is cycling out.

9. The method according to claim 7, wherein placing comprises placing, using the cleaning blade lubrication module, the lubrication stripe of marking material on a portion of the main surface of the charge receptor at a selected time.

10. The method according to claim 7, further comprising generating an image on media using the charge receptor.

11. A xerographic printing apparatus, comprising:

a media transport configured to transport media, a photoreceptor operable in a process direction, the photoreceptor having a main surface, the photoreceptor configured to generate an image on the media;

a cleaning station configured to clean the main surface of the photoreceptor, the cleaning station including a cleaning blade coupled to the main surface of the photoreceptor;

a cleaning blade lubrication module configured to place a lubrication stripe on a portion of the main surface of the photoreceptor at a selected time; and a controller coupled to the cleaning blade lubrication module and coupled to the photoreceptor, the controller configured to control stopping of photoreceptor motion so that the lubrication stripe has just begun to go under the cleaning blade when the charge receptor is stopped and the cleaning blade is in contact with the photoreceptor.

* * * * *